US005706531A

United States Patent [19]

Aubertine

[11] Patent Number: 5,706,531

[45] Date of Patent: Jan. 13, 1998

[54] UMBRELLA FRAME FOR POOL COVER

[76] Inventor: Roger R. Aubertine, 869 Rathburn Rd., Oswego, N.Y. 13126

[21] Appl. No.: 685,938

[22] Filed: Jul. 22, 1996

Related U.S. Application Data

[60] Provisional application No. 60/001,847 Aug. 2, 1995.

[51] Int. Cl.[6] ..... E04H 4/00

[52] U.S. Cl. ..... 4/498; 4/496

[58] Field of Search ..... 4/498, 496, 503; 135/98, 99, 124, 114

[56] References Cited

U.S. PATENT DOCUMENTS

| | | | |
|---|---|---|---|
| 3,769,639 | 11/1973 | Bishop | 4/172.12 |
| 3,889,698 | 6/1975 | Roessl | 135/98 |
| 4,038,997 | 8/1977 | Smith | 135/98 |
| 4,122,562 | 10/1978 | Sorrentino | 4/172.12 |
| 4,136,408 | 1/1979 | Dahlbeck et al. | 4/172.12 |
| 4,246,663 | 1/1981 | Aragona et al. | 4/500 |
| 4,805,654 | 2/1989 | Wang | 135/98 |
| 4,951,327 | 8/1990 | Del Gorio, Sr. | 4/498 |
| 5,148,646 | 9/1992 | Lutostanski | 52/64 |
| 5,259,077 | 11/1993 | Hager et al. | 4/498 |
| 5,303,527 | 4/1994 | Perez et al. | 52/632 |
| 5,371,907 | 12/1994 | Horvath | 4/498 |
| 5,551,464 | 9/1996 | Kelly | 135/98 |
| 5,564,453 | 10/1996 | Steiner | 135/98 |

*Primary Examiner*—David J. Walczak
*Attorney, Agent, or Firm*—Trapani & Molldrem

[57] ABSTRACT

An umbrella pool cover frame has a center post, e.g., PVC pipe, that rests on a base disk on the floor of the pool. An adjustable center support is positioned partway up the center post and held in place, e.g., with a pin. A top support disk is fitted to the top of the center post. The center and top support disks have bores to receive ends of support legs or ribs. In one embodiment, sixteen long support legs extend from ground to respective bores in the top disk, and sixteen short support legs extend between respective bores in the center disk and receptacles in the associated support legs. The weight of the frame and the cover is supported both on the center post and on the ground at the ends of the long support legs. For an oblong pool, there can be more than one center support post, and horizontal members or ribs that join the two associated top support disks. The top support disk and the base disk have protective mats to protect the pool floor and the pool cover. The support legs can be extruded aluminum tubing.

12 Claims, 7 Drawing Sheets

UMBRELLA FRAME FOR POOL COVER

This application claims priority for Applicant's earlier filed Provisional Application, Ser. No. 60/001,847, filed Aug. 2, 1995.

BACKGROUND OF THE INVENTION

The present invention relates to covers for swimming pools, and in particular is directed to a framework for supporting a swimming pool cover above the pool so that dirt, debris, snow, and other matter do not collect on the cover. The invention is also directed to a pool cover system that is inexpensive, simple for the pool owner to install, and yet is sturdy and strong.

Pool covers are used by owners of swimming pools to protect the pool from dirt, debris, and weather when the pool is not being used, and to discourage unauthorized use of the pool. The pool cover can be canvas, vinyl, or other material and is installed by stretching it over the pool. There are many advantages in having the pool cover elevated over the water, for example, preventing water, debris, snow or other material from collecting, and keeping children from climbing onto the pool cover. The cover can be elevated over the pool either by installing an inflated floatation device in the pool beneath the cover, or by using a rigid framework that is erected onto or over the pool. Several supports and frames for swimming pool covers have been proposed, and a few of these are described in Hager et at. U.S. Pat. No. 5,259,077; Dalaibeck et at. U.S. Pat. No. 4,136,408; and Sorrentino U.S. Pat. No. 4,122,562. These pool covers have rib members that must be installed directly onto the rim of the pool, or onto a peripheral rail structure. This limits flexibility in installation, and each pool cover must be custom fit to a specific pool.

OBJECTS AND SUMMARY OF THE INVENTION

An object of this invention is to provide a pool cover that is constructed of low-cost, standard parts, and which the pool owner can install easily and without special tools or any special training. Because the frame for the pool cover rests on the ground rather than on the fixtures attached to the rim or deck of the pool, a standard kit can be used with any of a variety of pools, and both the numbers of parts and the complexity of the pool frame is kept minimal.

It is another object to provide a pool cover that is lightweight and can be erected safely and easily by a small crew, and in some cases by a single individual.

The umbrella pool cover frame has a center pole or post, e.g., polypropylene pipe, that rests on a base disk on the floor of the pool. There is an adjustable center support positioned partway up the center pole and held in place, e.g., with a pin, and a top support disk. The center and top support disks can be wood, with steel support disks for reinforcement. These support disks have bores to receive ends of support legs or ribs.

There is a sufficient number of ribs that extend out from the center pole to support the pool cover. In one embodiment, sixteen ribs are used. That means there are sixteen long support legs that each extend from a ground support outside the pool to a respective bore in the top support disk, and sixteen short support legs that each extend from a respective bore in the center support disk to an associated one of the long support legs. Each of the long support legs has a receptacle into which the upper end of the short leg is inserted. The outer part of each of the long support legs has a bend, for example forty-five degrees, so that the frame will clear the side of the pool. The outer ends of the long support legs rest on the ground in a foot member, which can be a block of wood or durable plastic. The weight of the frame and the cover is supported both on the center post and on the ends of the long support legs.

For an oblong pool, there can be more than one center support post, and horizontal members or ribs that join the two associated top support disks. In that case, the long support legs can be different lengths, whereas for the round pool the long support legs can be all the same length.

The top of the top support disk and the bottom of the base disk have a layer of rubber or similar yieldable material so that the pool floor and the pool cover are not damaged.

In a preferred mode, the support legs are formed of one-and-one-quarter inch extruded aluminum tubing, e.g., electrical conduit. One-inch or three-quarter inch tubing could be used. This material is lightweight and durable, as well as being relatively inexpensive. However, PVC piping or other materials could be used, if desired.

DESCRIPTION OF THE PREFERRED EMBODIMENT

Figure 1:
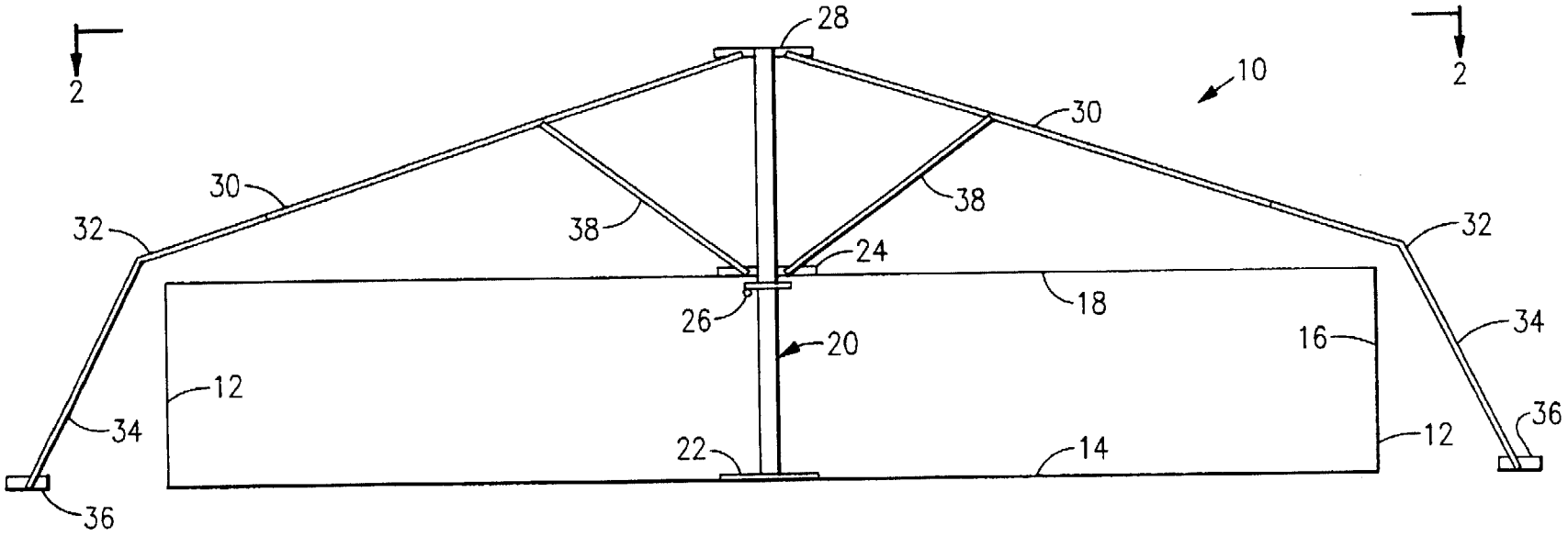
FIG. 1 is an elevation of a circular above-ground pool and umbrella pool cover frame of one embodiment of this invention, the elevation being taken at line 1—1 of FIG. 2.
Figure 2:
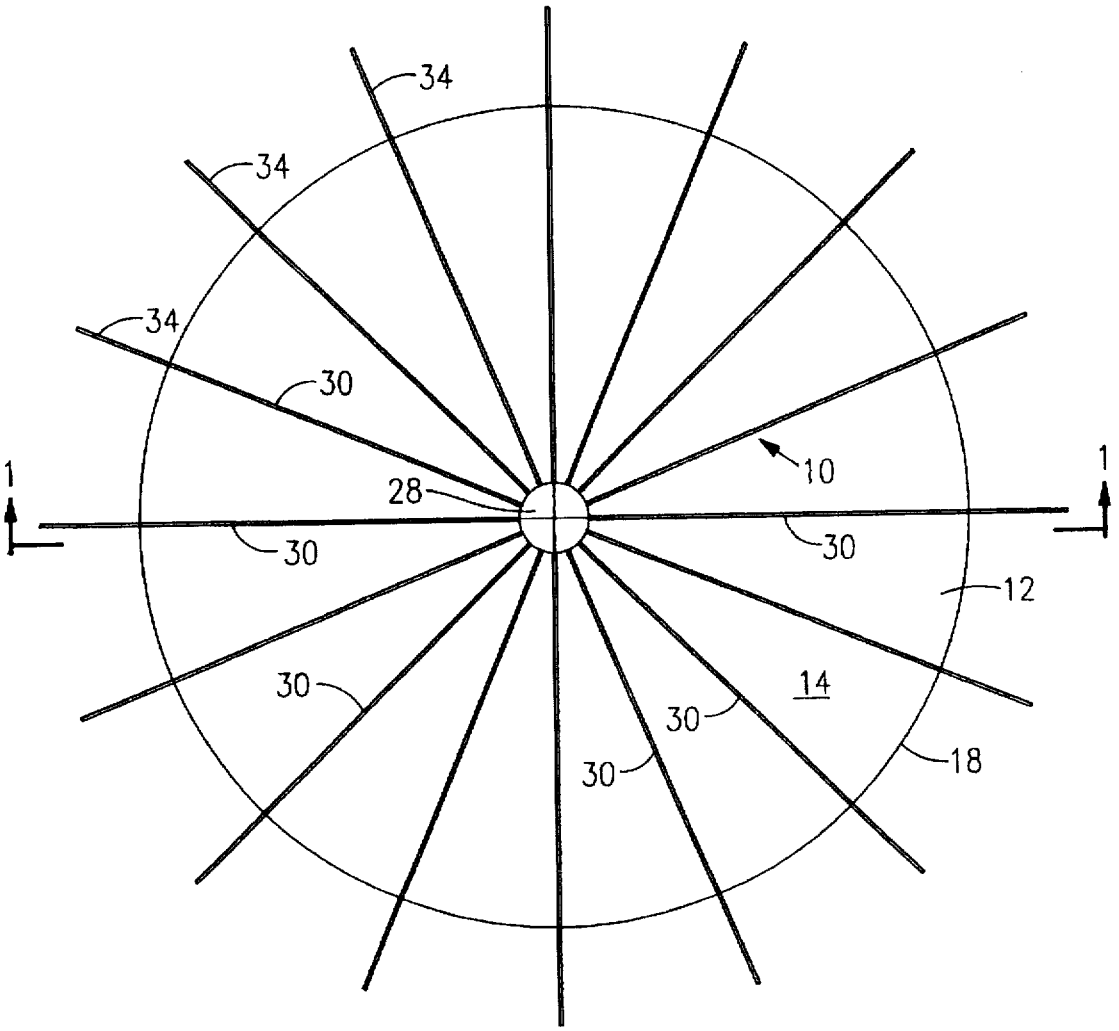
FIG. 2 is a top plan view taken at 2—2 of FIG. 1.

With reference to the Drawing, and initially to FIGS. 1 and 2, an umbrella pool cover frame 10 is shown associated with a round above-ground swimming pool 12, the pool having a floor 14 and a generally cylindrical wall 16 with an upper peripheral rim 18. The frame 10 has a vertical post 20 that rests on a base disk 22 on the floor 14 of the pool, a central support disk 24 positioned partway up the post 20 and held in place by a pin 26, and a top support disk 28 at the top of the center post 20. There are a plurality of ribs or support legs 30 that extend radially from sockets in the top support disk 28 at a downward angle (here about 18°) to a position just beyond the rim 18 of the pool. There, each of the legs 30 has a bend 32 (here about 45°) and an outer part 34 of the leg reaches to the ground outside the pool wall 16. Preferably, the outer parts 34 of the main support legs rest on wood blocks 36 or other support feet. As shown in FIG. 2, in this embodiment there are sixteen support legs 30 positioned at regular angular intervals.

A similar number of short support legs 38 or braces extend upward from the center support disk 24 to respective ones of the main support legs 30. The lower ends of the legs 38 are inserted into sockets in the support disk 24 and upper ends of the legs 38 are received in suitable receptacles provided on the main support legs 30.

This umbrella pool cover frame 10 can support any suitable pool cover, which can be for example a canvas-like material or a vinyl or other plastic film. The cover itself is not shown here. The cover can be stretched easily over the frame, and then suitably tied or staked in place.

Figure 3:
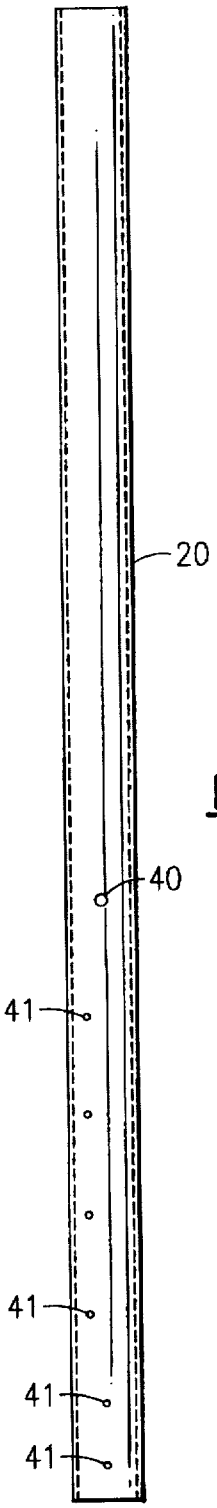
FIG. 3 is an elevation of the enter pole of this embodiment.

The center post 20 is shown in FIG. 3, and in this embodiment is a PVC pipe with an outer diameter of 3.5 inches and a length of 8 feet 6 inches. For very large pools, PVC pipe of 4.5 inch diameter could be used. An 0.75 inch hole 40 through both sides receives the pin 26 for the center support disk 24. There are a number of breather holes 41 bored every few inches into the post 20 starting about two feet from the bottom. The breather holes accomodate expansion and contraction of water that remains in the pool when the pool is covered. The breather holes 41 are disposed axially along the post 20, and can be in line or spiraling around the post.

Figure 4:
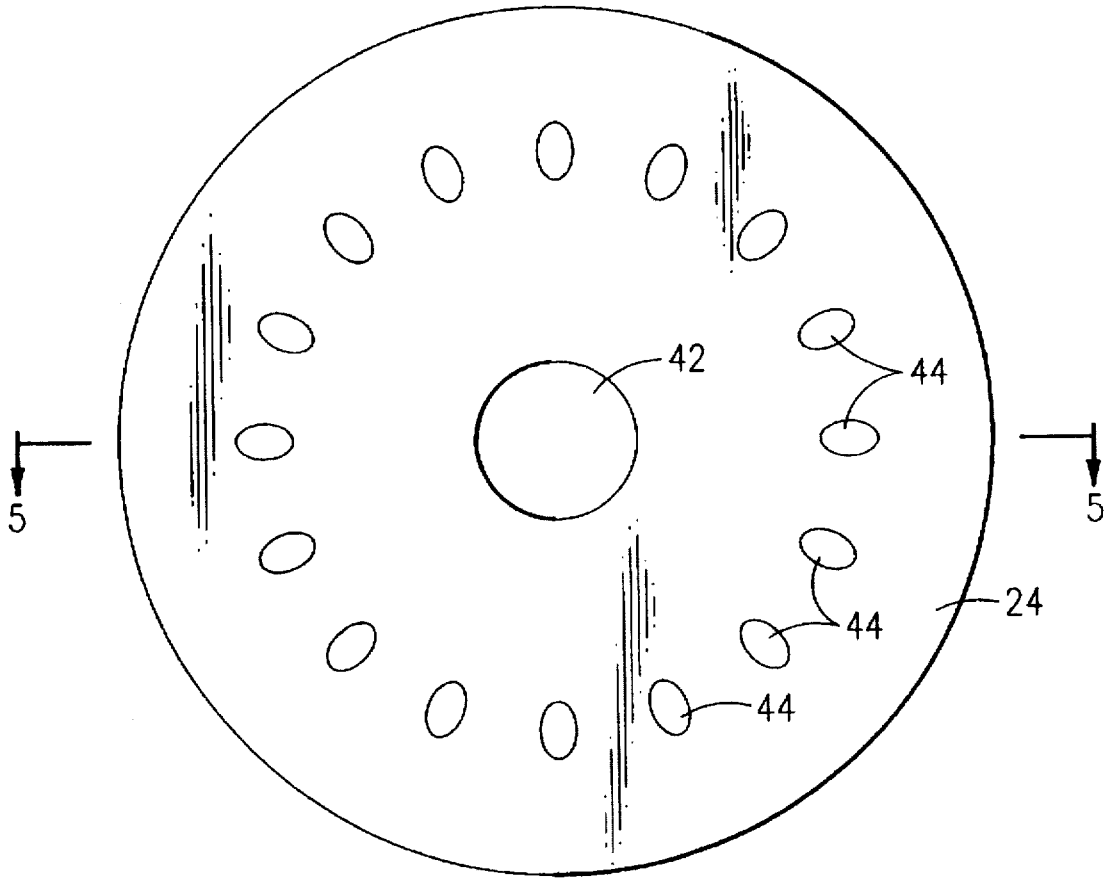
FIGS. 4 and 5 are plan and elevational cross sectional views of the center support disk of this embodiment.
Figure 5:
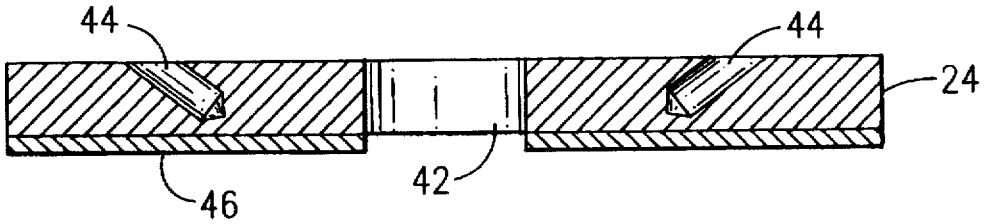

The center support disk 24 is shown in FIGS. 4 and 5. The disk 24, which can be wood, is about twenty-four inches in diameter, and has a center hole 42 that rides on the post 20. The disk 24 has sixteen one-inch bores 44 or sockets drilled out at regular intervals on an eight-inch radius circle on the disk. These bores or sockets are drilled at an angle, in this embodiment at 38°. A circular steel support plate 46 is affixed onto the under side of the disk, as shown in FIG. 5.

Figure 6:
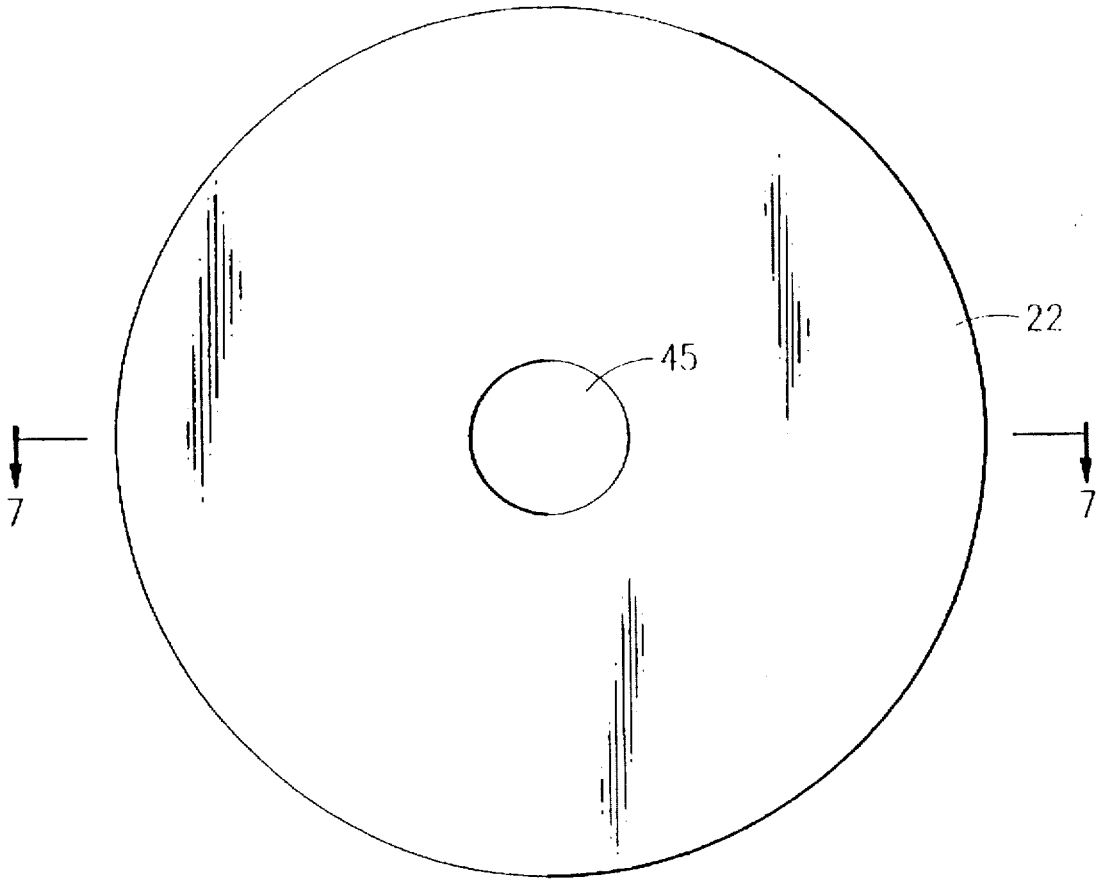
FIGS. 6 and 7 are plan and elevational cross sectional views of the base disc of this embodiment.
Figure 7:
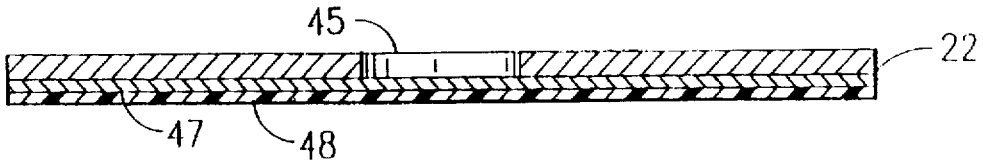

The base disk 22 is shown in FIGS. 6 and 7. This base disk has a diameter of about twenty-four inches, a thickness of about three-quarters inch, and a center bore 45 of three-and-one-half inches to receive the lower end of the post 20. There is a circular steel plate 47 (FIG. 7) affixed onto the underside of the disk 22, and a circular rubber mat 48 beneath that to protect the pool floor 14. The relatively large surface area of the disk 22 distributes the weight of the frame and pool cover over a large footprint on the pool floor, and this also helps protect the pool floor 14.

Figure 8:
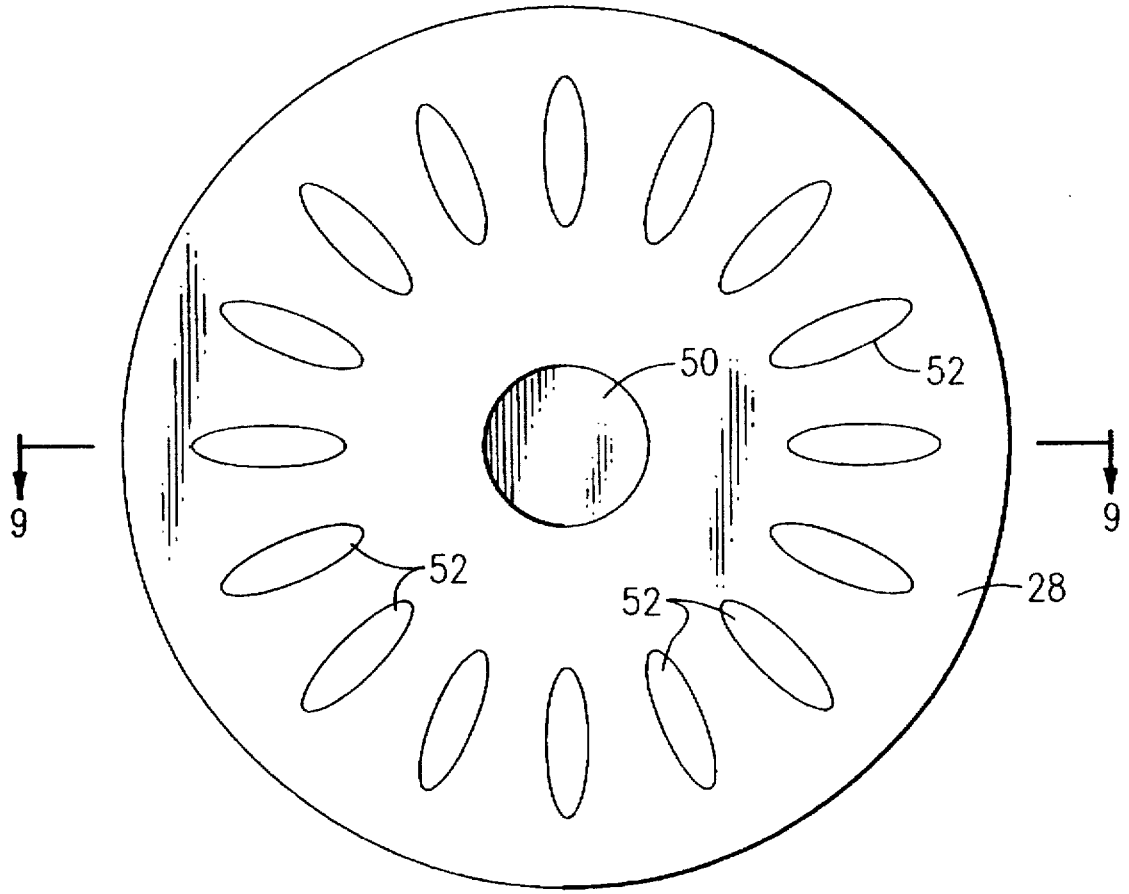
FIGS. 8 and 9 are plan and elevational cross sectional views of the top support disk of this embodiment.
Figure 9:
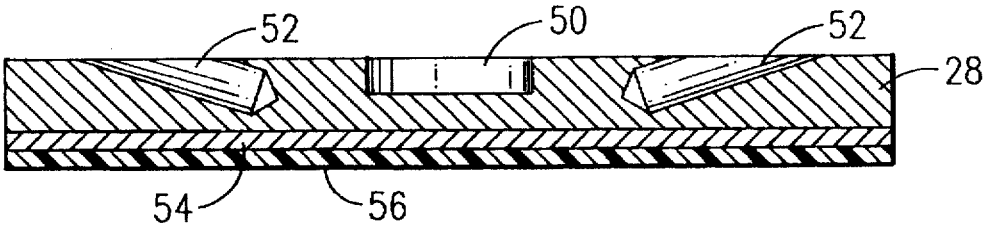

The top support disk 28 is shown in FIGS. 8 and 9 (here FIG. 9 is shown inverted with respect to FIG. 1). The top disk 28 has a center bore 50 for the center post 20. The disk 28 in this embodiment has a diameter of about twenty-four inches and is about two inches thick. There are sixteen one-and-one-quarter inch bores 52 or sockets drilled out at regular intervals on an eight-inch radius circle. The bores 52 are drilled at a shallow angle, in this embodiment at 18°. A circular steel plate 54 is affixed onto the top of the disk 28, and an upper rubber mat 56 is attached to that for protecting the pool cover.

Figure 10:
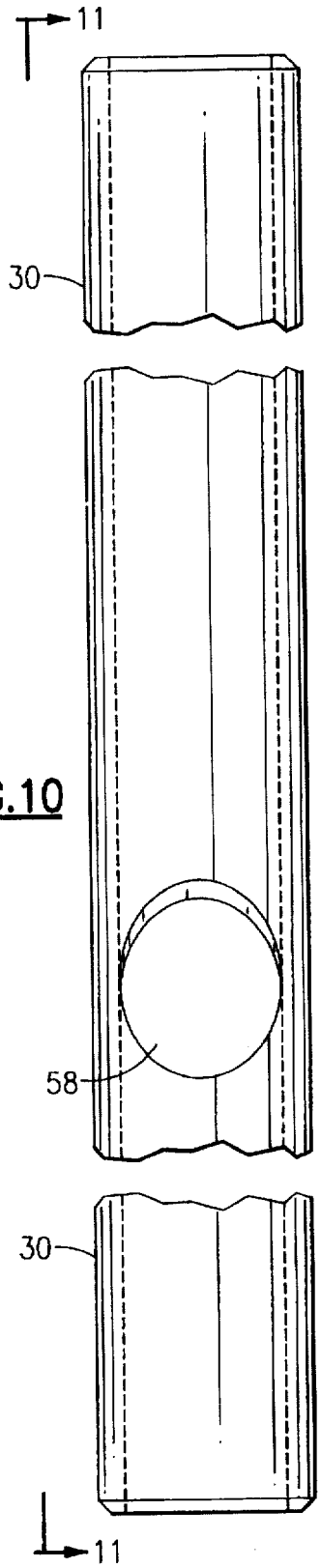
FIGS. 10 and 11 are bottom and side views of a long support leg of this embodiment, FIG. 11 being taken at 11—11 of FIG. 10.
Figure 11:
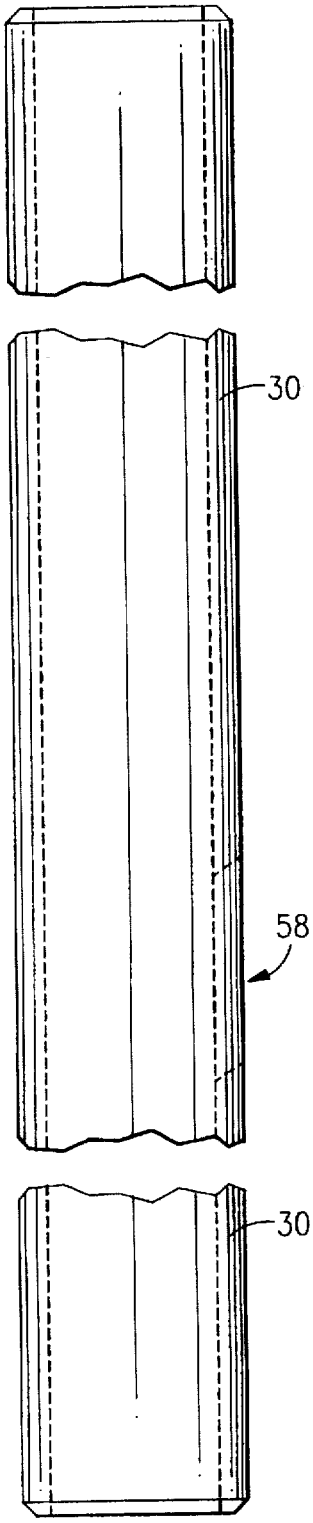

Details of the main support legs 30 are shown in FIGS. 10 and 11. Here the legs 30 are made of 1.25 inch O.D. extruded alumimim tubular conduit, with chamfers formed at both ends. A one-inch hole 58 is bored at an angle (here 56°) at a position four feet two inches from the central end and the upper end of the short support leg 38 fits into this hole 58. Other configurations are possible, but it is preferred that the hole 58 is between the central end of the main support leg 30 and the bend 32.

Figure 12:
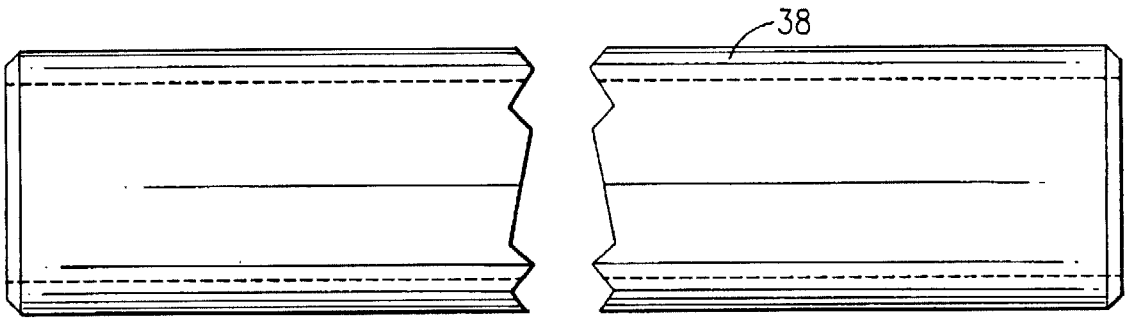
FIG. 12 is a side view of a short support leg of this embodiment.

The short legs 38 are constructed as shown in FIG. 12. These legs 38 are formed of 1.0 inch O.D. extruded aluminum tubular conduit, with chamfers at each end. The legs 38 are about five feet in length, and fit into the bores 44 in the center support disk and into the holes 58 of the respective long support legs 30.

Alternatively, the disks 24 and 28 could have male fittings, rather than the bores or sockets 44 and 52, which could mate with female fittings on the support legs or ribs 30 and 38, e.g., pins which would fit into the open ends of the tubular legs. Also, rather than the holes 58 on the main support legs 30, an alternative fitting arrangement could be used, such as a male fitting or pin which could fit into the open (female) end of the short legs 38. Many other suitable connection or fitment arrangements will occur to persons in the trade.

The parts of this pool cover frame 10 can easily be handled by one person working alone, and can be assembled in under an hour. Once erected the umbrella pool frame is quite rigid, and will support the pool cover without buckling, even under high wind loading or snow loading conditions. The outer ends 34 of the long legs 30 can be cut or trimmed as necessary, using a tubing cutter, when necessary to erect the umbrella pool cover frame on uneven ground. Then, the shortened legs can be painted or marked with tags provided with the frame kit.

Figure 13:
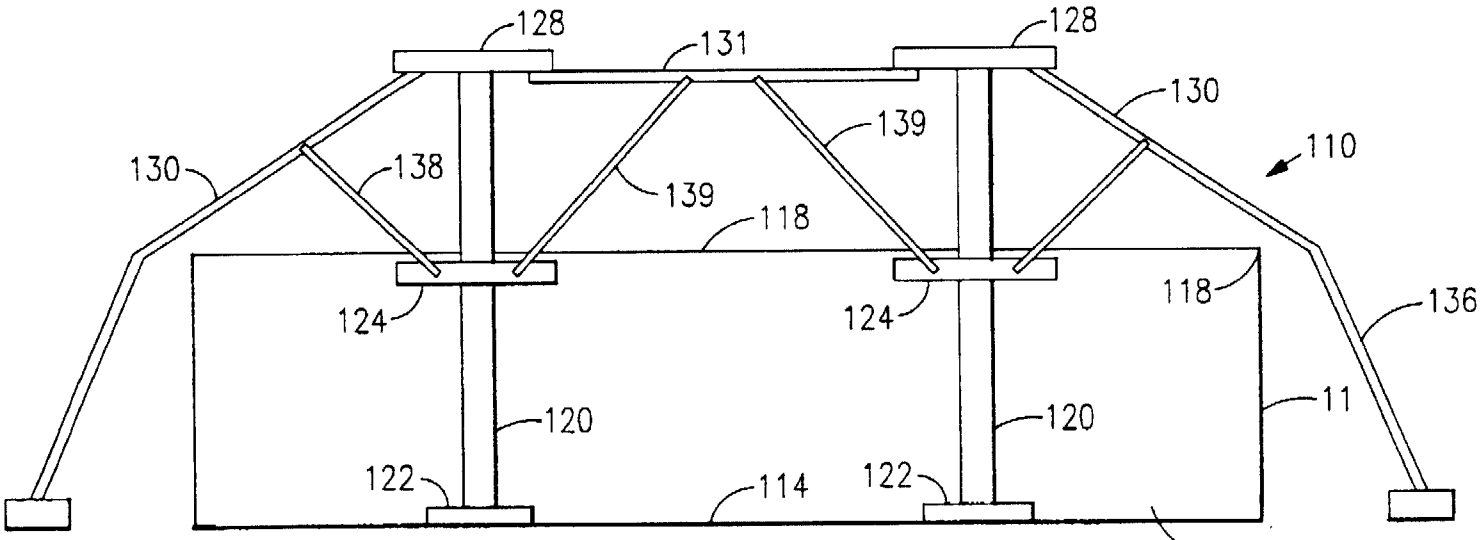
FIG. 13 is an elevation of a non-circular above-ground pool and umbrella pool cover frame of a second embodiment of this invention.

A variant of this umbrella pool cover frame 110 for an oblong shaped pool 112 is shown in FIG. 13. Here, the parts that are employed that are similar to parts in the first embodiment are identified with the same reference numbers, but raised by 100. The pool 112 is shown in section in the longer dimension of the pool. There are two posts 120, each supported on a bottom disk 122, and each with a center disk 124 and a top disk 128. The long legs or ribs 130 are similar to those described earlier, and are supported in the top disk 28 and by the short legs 138. In addition, the two top disks 128, 128 are connected to one another by horizontal legs 131, which are braced by a pair of short support legs 139, 139 that rise from the associated center support disks 124, 124. The legs 130 will have suitable dimensions to extend over the rim 118 or deck of the pool. Of course, there could be more than one horizontal leg 131; for example, two of these legs could be paired and connected in parallel between the two top disks 128, 128.

Further pool cover frames for other sizes and shapes of outdoor pools could have three or more center posts, depending on design considerations. Also, the same principle of construction as described above could be used for a pool cover frame for an in-ground pool. The materials and construction shown and described here represents one of many ways in which the pool cover frame of this invention could be practiced. Certainly, many other materials and many other ways of coupling the parts together could be employed. While the invention has been described in detail with respect to a few preferred embodiments, many modifications and variations would present themselves to persons of skill in this art, without departing from the scope and spirit of the present invention, which is defined in the appended claims.

I claim:

1. An umbrella pool cover frame for a swimming pool that has a floor and a peripheral wall, with a ground surrounding said peripheral wall; the pool cover frame comprising:

a main post adapted to be vertically disposed in said pool;

a base member adapted to be disposed on the floor of the pool and upon which rests a lower end of said main post;

an adjustable center support adjustably positioned on said main post;

a top support member positioned at an upper end of said main post;

a plurality of substantially rigid support legs having inner ends removably connected to said top support member and extending radially from the top support member to the ground beyond said peripheral wall, including means for supporting outer ends of said legs on said ground; and a plurality of substantially rigid support ribs extending from said center support, each said rib having a first end supported on said center support and a second end removably received in receptacle means on a corresponding one of said support legs.

2. The pool cover frame of claim 1 wherein said support legs each have a bend therein to permit the frame to clear the peripheral wall of the pool.

3. The pool cover frame of claim 1 wherein the receptacle means of said support legs include a fitting onto which the second end of the associated support rib is coupled.

4. The pool cover frame of claim 1 wherein said base member includes a plate member having an upper side on which rests the lower end of said main post, and a protective mat disposed on a lower side of said plate member to protect the floor of the pool.

5. The pool cover frame of claim 4 wherein said plate member has receptacle means on an upper side thereof for removably attaching to the lower end of said main post.

6. The pool cover frame of claim 1 wherein said top support member comprises a disk having a center socket member to receive the upper end of said main post, and a protective mat disposed on an upper side of said disk.

7. The pool cover frame of claim 1 wherein said post is a tubular member having a plurality of breather holes bored therein at positions disposed axially along the post to accommodate expansion and contraction of water in said pool.

8. The pool cover frame of claim 1 wherein said support legs are tubular aluminum extrusions.

9. The pool cover frame of claim 8 wherein the inner and outer ends of said support legs are chamfered, and said top support member includes a plurality of bores into which the inner ends of the respective legs are received.

10. The pool cover frame of claim 9 wherein said support ribs include tubular extruded aluminum members having chamfers at least at their said one ends, and said center support includes a plurality of bores into which the first ends of the respective support ribs are received.

11. An umbrella pool cover frame for a swimming pool that has a floor and a peripheral wall, with a ground surrounding said peripheral wall; the pool cover frame comprising:

a main post adapted to be vertically disposed in said pool;

a base member adapted to be disposed on the floor of the pool and upon which rests a lower end of said main post;

an adjustable center support positioned on said main post;

a top support member positioned at an upper end of said main post;

a plurality of support legs having inner ends connected to said top support member and extending radially from the top support member to the ground beyond said peripheral wall, including means supporting outer ends of said legs on said ground;

a plurality of support ribs extending from said center support, each said rib having a first end supported on said center support and a second end received in receptacle means on a corresponding one of said support legs;

a second main post adapted to be vertically disposed in said pool;

a second base member adapted to be disposed on the floor of the pool, spaced from the first-mentioned base member, and upon which rests a lower end of the second main post;

a second adjustable center support positioned on the second main post;

a second top member positioned at an upper end of the second main post;

a second plurality of support legs having inner ends connected to said second top member and extending radially from the second top member to the ground beyond said peripheral wall, including means for supporting outer ends of said legs on said ground;

a second plurality of support ribs extending from said second center support, each such rib having a first end supported on said second center support and a second end received in receptacle means on a corresponding one of said second plurality of support legs; and at least one additional support leg extending between the first-mentioned and the second top support members.

12. The pool cover frame of claim 11, further comprising at least first and second additional support ribs, said first and second additional support ribs respectively having a first end attached to the first-mentioned and the second center supports, and a second end connected to receptacle means on said at least one additional support leg.

* * * * *